United States Patent [19]

Secrist

[11] 4,207,036

[45] Jun. 10, 1980

[54] SUBSURFACE PUMPING INSTALLATION FOR HANDLING VISCOUS OR SAND-LADEN FLUIDS

[75] Inventor: Walter S. Secrist, Dallas, Tex.

[73] Assignee: United States Steel Corporation, Pittsburgh, Pa.

[21] Appl. No.: 878,205

[22] Filed: Feb. 16, 1978

[51] Int. Cl.[2] ..... F04B 21/00; F04B 39/00

[52] U.S. Cl. ..... 417/431

[58] Field of Search ..... 417/431, 451–453

[56] References Cited

U.S. PATENT DOCUMENTS

| | | | |
|---|---|---|---|
| 1,533,440 | 4/1925 | Marty | 417/451 |
| 3,146,940 | 9/1964 | McCrory et al. | 417/364 |
| 3,418,938 | 12/1968 | Vincent | 417/431 |
| 3,802,802 | 4/1974 | Greer | 417/431 |
| 4,056,335 | 11/1977 | Secrist | 417/431 |
| 4,089,626 | 5/1978 | Hill etal. | 417/431 |

*Primary Examiner*—William L. Freeh

*Attorney, Agent, or Firm*—Walter P. Wood

[57] ABSTRACT

A subsurface pumping installation in which solvent or diluent is introduced to the well from the surface and blends with the well fluid to enable it to be pumped more readily. The diluent is introduced through a power tubing which may be either concentric with the casing or concentric with a production tubing within the casing. A mixture of well fluid and diluent is conducted to the surface through an annulus which surrounds the power tubing. The diluent is injected into the well fluid in a blending chamber inside the pump, where it blends effectively without loss into the formation around the pump.

7 Claims, 7 Drawing Figures

SUBSURFACE PUMPING INSTALLATION FOR HANDLING VISCOUS OR SAND-LADEN FLUIDS

This invention relates to an improved subsurface pumping installation for handling viscous or sand-laden fluids.

In pumping viscous or sand-laden fluids from a well, it is known to introduce solvents or diluents to the well from the surface. The diluent blends with the well fluid and enables it to be pumped to the surface more readily. In such installations the diluent is conducted downward to the pump through a power tubing which also accommodates a sucker rod string for operating the pump. The mixture of well fluid and diluent may be conducted to the surface through a production tubing parallel with the power tubing, or through an annulus between the power tubing and a concentric casing or an annulus between the power tubing and a concentric production tubing within the casing. Reference can be made to my earlier U.S. Pat. No. 4,056,335 or to Greer U.S. Pat. No. 3,802,802 for exemplary showings of pumping installations which have parallel tubing strings, and to Haines U.S. Pat. No. 2,567,513 for an exemplary showing of a concentric arrangement.

A concentric installation makes better use of the space available within the casing, since there is considerable waste space around parallel tubing strings. Normally at least a 7-inch diameter casing is required to accommodate parallel tubing strings. Many Canadian oil fields, which produce viscous crude, have wells with 4½ or 5½ inch diameter casing. However, in previous concentric arrangements, of which the Haines showing is typical, the diluent is introduced to the well fluid beneath the standing valve at the bottom of the pump and/or within the fluid-conducting annulus. Diluent introduced beneath the standing valve is at least partially lost into the formation around the pump. Diluent introduced within the fluid-conducting annulus does not blend effectively with the well fluid. The resulting bulk injection of diluent may cause debris or sand to fall out in slugs in the bottom of the annulus and thus "sand-in" the pump.

An object of the present invention is to provide improved concentric arrangements for introducing diluent to a pumping installation in which no diluent is lost to the formation, and in which diluent blends more effectively with the well fluid.

A more specific object is to provide arrangements which accomplish the foregoing object and in which diluent is injected into the well fluid within a blending chamber inside the pump, located either between standing and discharge valves or above the discharge valve.

Figure 1:
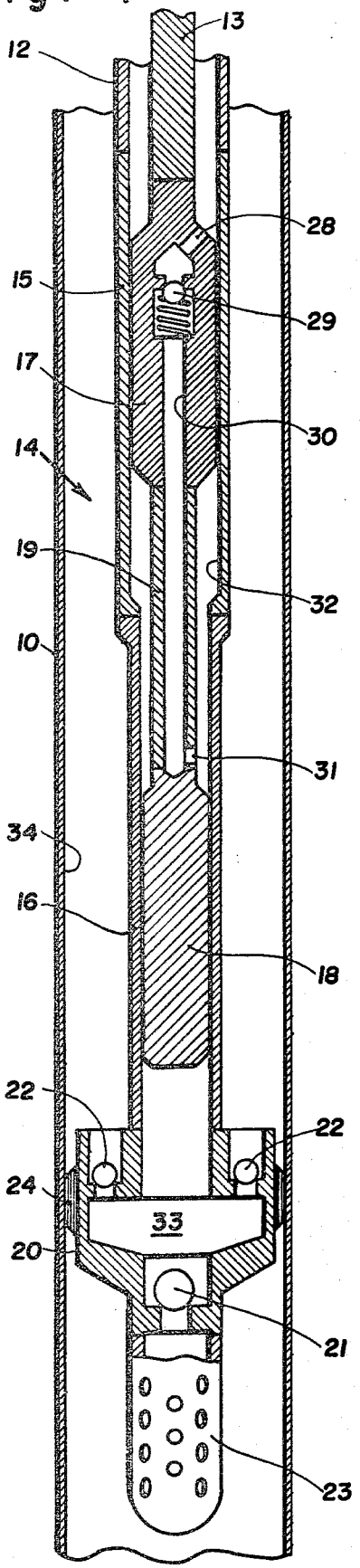
FIG. 1 is a diagrammatic vertical sectional view of a pumping installation constructed in accordance with the invention in which the fluid-conducting annulus is located between the power tubing and a concentric casing and in which the blending chamber is located between standing and discharge valves.

FIG. 1 shows a pumping installation which includes a casing 10, a concentric power tubing 12 within the casing, a sucker rod string 13 within the power tubing, and a pump 14. The pump comprises upper and lower barrels 15 and 16 joined end-to-end, upper and lower plungers 17 and 18 within the respective barrels, and a pull tube 19 connecting the two plungers. The power tubing 12 is joined to the upper pump barrel 15 and the sucker rods 13 are joined to the upper plunger 17 to move the plungers up and down within the barrel. Inertia bars (not shown) may be inserted between the sucker rod string and the upper plunger to add weight and maintain the sucker rods under tension, as described in my joint application with Michael L. Rizzone, Ser. No. 731,596, filed Oct. 12, 1976. The pump 14 also comprises a crossover 20 which is joined to the lower end of the lower pump barrel 16 and contains a standing valve 21 and one or more discharge valves 22. A conventional strainer 23 is joined to the lower end of the crossover. A packer 24 is placed between the outside of the crossover and the inside of the casing 10. To simplify the drawing, some conventional parts such as couplings are not shown.

The power tubing 12 serves to conduct diluent from the surface downward to the pump. The diluent enters the upper plunger 17 through a port 28, passes through a check valve 29 in the upper plunger and through a passage 30 in the upper plunger and pull tube 19, and out a port 31 into an annular chamber 32 within the two barrels 15 and 16. From the chamber 32 the diluent leaks past the loosely fitting lower plunger 18 and thus is injected into a blending chamber 33 in the crossover 20 beneath the plunger and between the standing and discharge valves 21 and 22.

During upstrokes of the two plungers 17 and 18 well fluid is drawn through the standing valve 21 into the blending chamber 33 where the diluent blends with it. During downstrokes of the plungers the mixture of well fluid and diluent is forced through the discharge valves 22 into the annulus 34 between the casing 10 and power tubing 12. The annulus conducts the fluid mixture to the surface. The packer 24 prevents the mixture from flowing back to the formation, and the check valve 29 prevents diluent from backing up during downstrokes. Slippage of the injected diluent past the lower plunger 18 cleans the wearing surfaces of the lower plunger and barrel.

Figure 2:
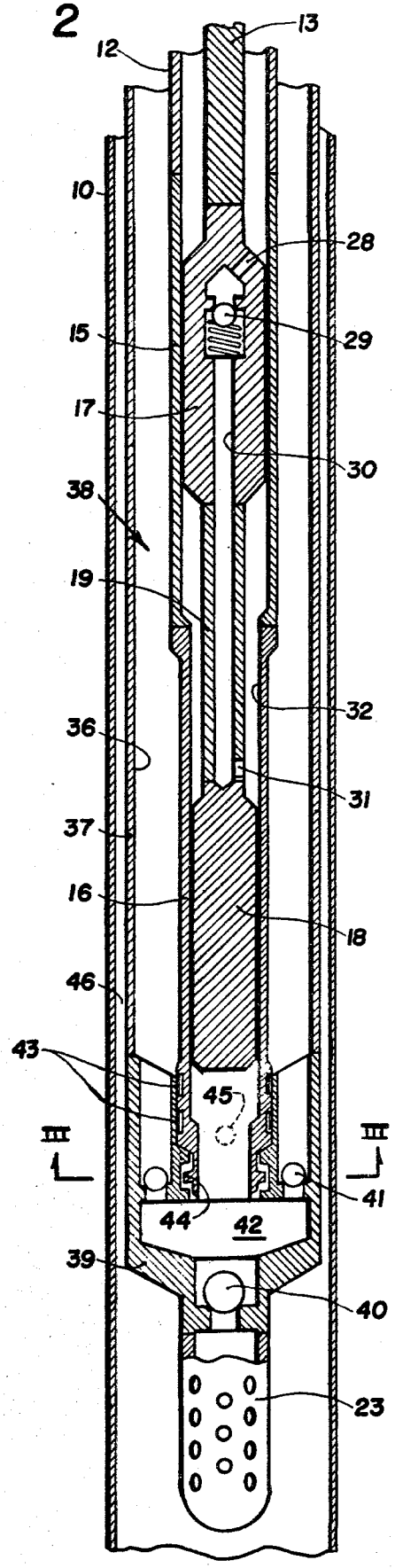
FIG. 2 is a similar view but showing a modification in which the fluid-conducting annulus is between the power tubing and a separate concentric production tubing within the casing.
Figure 3:
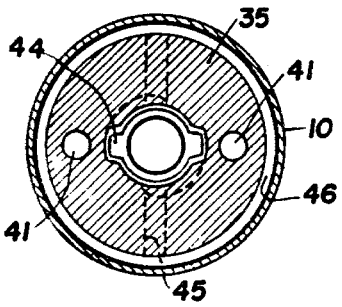
FIG. 3 is a horizontal section on line III—III of FIG. 2.

FIGS. 2 and 3 show a modification in which the fluid-conducting annulus 36 is situated between the power tubing 12 and a separate production tubing 37. The casing 10, power tubing 12, sucker rods 13, pump barrels 15 and 16 and plungers 17 and 18 are similar to corresponding parts shown in FIG. 1. The path of diluent into the well also is similar. Hence the description is not repeated.

The pump 38 of FIGS. 2 and 3 comprises a crossover 39 which is fixed to the lower end of the production tubing 37, and contains standing and discharge valves 40 and 41. The space beneath the lower plunger 18 and between the standing and discharge valves forms a blending chamber 42 similar to chamber 33 shown in FIG. 1. The lower barrel 16 of the pump carries packing rings 43 which are received in the crossover 39 to afford a seal between the lower barrel and the crossover. Preferably the lower barrel 16 and crossover 39 are equipped with cooperating locking means 44 which are engaged or disengaged by rotating the power tubing 12 and the two pump barrels. Preferably the crossover has a drain port 45 normally covered by the lower barrel 16 as long as the pump is in place as shown in FIG. 2. Whenever the pump barrels are pulled from the well, port 45 is uncovered to permit fluid to drain from the production tubing 37 back to the well.

The modification shown in FIGS. 2 and 3 eliminates need for the packer 24 used in the embodiment shown in FIG. 1. This is important for pumping fluid which is at a relatively high temperature, since the rubber packer cannot withstand high temperature for long periods. The modification shown in FIGS. 2 and 3 enables gas to be vented from the well through an annulus 46 between the casing 10 and production tubing 37. The annulus 46 also provides a space into which an inhibiting fluid may be introduced to protect the casing and production tubing.

Figure 4:
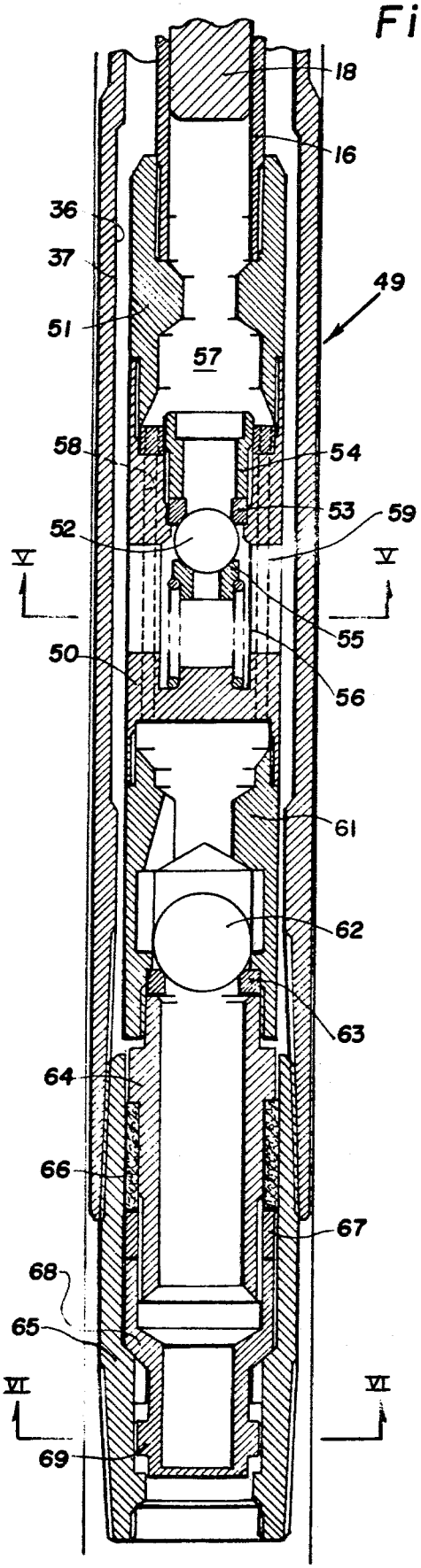
FIG. 4 is a vertical sectional view of another modification in which the blending chamber is located above the discharge valve.
Figure 5:
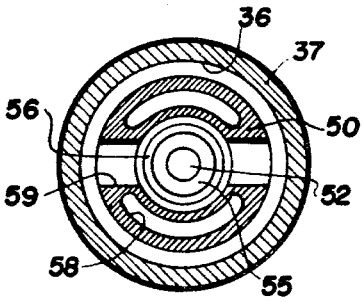
FIG. 5 is a horizontal section on line V—V of FIG. 4.
Figure 6:
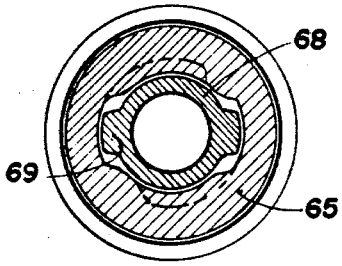
FIG. 6 is a horizontal section on line VI—VI of FIG. 4.

FIGS. 4, 5 and 6 show another modified installation particulary useful for small diameter casings. The lower barrel 16 and lower plunger 18 of the pump and parts thereabove may be similar to corresponding parts shown in FIGS. 1 and 2; hence the showing and description are not repeated. FIG. 4 shows a fluid-conducting annulus 36 within a production tubing 37 similar to FIG. 2, but it is apparent the production tubing could be omitted as in the embodiment of FIG. 1.

The pump 49 of the embodiment of FIGS. 4, 5 and 6 includes a crossover 50 and a bushing 51 joining the crossover to the lower end of the pump barrel 16. The crossover contains a discharge valve 52, a downwardly facing seat 53 for valve 52, a plug 54 holding seat 53 in position, a guide 55 abutting the underside of valve 52, and a spring 56 acting against guide 55 to hold valve 52 closed against its seat 53. The space within the bushing 51 and lower end of the pump barrel 16 forms a blending chamber 57. The crossover 50 has vertical passages 58 extending from its lower end to the blending chamber, and ports 59 affording communication between the discharge valve 52 and the annulus 36 (FIG. 5).

A standing valve cage 61 is joined to the lower end of the crossover 50 and contains a standing valve 62 and a seat 63 therefor. A mandrel 64 is joined to the lower end of the standing valve cage. A seating nipple 65 is joined to the lower end of the production tubing 37. A packer 66 is placed between the mandrel 64 and seating nipple 65 to close the lower end of the annulus 36. The packer is held in place by a lock nut 67 and plug 68. Preferably the seating nipple 65 and plug 68 are equipped with cooperating locking means 69 similar to the locking means shown in FIG. 2.

During the upstrokes of the plungers well fluid is drawn through the standing valve 62 and vertical passages 58 into the blending chamber 57. Diluent leaks past the lower plunger 18 to the blending chamber as in the embodiments already described and blends with the well fluid. During downstrokes of the plungers the mixture of well fluid and diluent is forced through the discharge valve 52 and ports 59 into the annulus 36, which conducts the fluid mixture to the surface. The packer 66 prevents the fluid mixture from flowing back to the formation.

Figure 7:
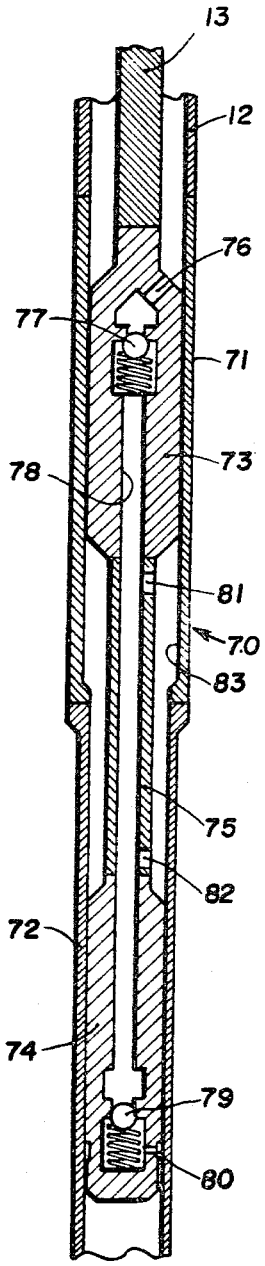
FIG. 7 is a view similar to FIG. 1, but showing a plunger which has a modified arrangement for conducting diluent to the blending chamber; and which may be used in any of the pumps shown in FIGS. 1, 2 or 4.

FIG. 7 shows a pump 70 which has a modified arrangement for conducting diluent to the mixing chamber. Pump 70 comprises upper and lower barrels 71 and 72 joined end-to-end, upper and lower plungers 73 and 74 within the respective barrels, and a pull tube 75 connecting the two plungers. Diluent conducted down the power tubing 12 enters the upper plunger through a port 76, passes through a check valve 77 in the upper plunger and through a passage 78 which extends through the upper plunger and pull tube 75 almost to the bottom of the lower plunger 74. Diluent discharges from passage 78 through a check valve 79 and port 80 near the bottom of the lower plunger 74 into the lower barrel 72 and thence is injected into the blending chamber. The pull tube 75 also has ports 81 and 82 through which diluent discharges into an annular chamber 83 within the two pump barrels. Such diluent leaks past the lower plunger to the blending chamber as in the embodiments already described. The modified pump 70 may be used in either embodiment of the installation shown in FIGS. 1, 2 or 4 in place of the pump 14, and has the advantage of injecting diluent more directly into the blending chamber.

From the foregoing description it is seen that the present invention affords simple concentric arrangements for introducing diluent to a well, and at the same time assuring that the diluent and well fluid mix properly without losing diluent to the surrounding formation. Since the diluent is injected into a body of well fluid within a blending chamber inside the pump, there is no likelihood of bulk injection of diluent into an annulus and causing sand to fall out.

I claim:

1. In a subsurface pumping installation which includes:

a power tubing which conducts diluent from the surface;

a string of solid sucker rods extending from the surface down said power tubing within the diluent;

a pump having at least one barrel joined to said power tubing, at least one plunger in said barrel joined to said sucker rod string, a crossover at the bottom of said barrel, and standing and discharge valves in said crossover;

means forming a blending chamber inside and pump beneath said plunger; and means forming a passage in said plunger communicating with said power tubing and with said barrel for delivering diluent to said barrel and thence around said plunger to said chamber;

said plunger on its upstroke drawing well fluid through said standing valve into said chamber where it blends with diluent;

said plunger on its downstroke forcing a mixture of well fluid and diluent from said chamber through said discharge valve;

the improvement comprising:

a casing forming a fluid-conducting annulus which surrounds said power tubing and is concentric therewith; and a packer between said crossover and said casing closing the bottom of said annulus, said crossover being attached to said barrel;

said discharge valve providing communication between said chamber and said annulus enabling said annulus to receive the mixture of well fluid and diluent and conduct the mixture to the surface out of contact with said plunger and said sucker rods.

2. In a subsurface pumping installation which includes:

a power tubing which conducts diluent from the surface;

a string of solid sucker rods extending from the surface down said power tubing within the diluent;

a pump having at least one barrel joined to said power tubing, at least one plunger in said barrel joined to said sucker rod string, a crossover at the bottom of said barrel, and standing and discharge valves in said crossover;

means forming a blending chamber inside said pump beneath said plunger; and means forming a passage in said plunger communicating with said power tubing and with said barrel for delivering diluent to said barrel and thence around said plunger to said chamber;

said plunger on its upstroke drawing well fluid through said standing valve into said chamber where it blends with diluent;

said plunger on its downstroke forcing a mixture of well fluid and diluent from said chamber through said discharge valve;

the improvement comprising:

a production tubing forming a fluid-conducting annulus which surrounds said power tubing and is concentric therewith, said crossover being attached to said production tubing;

a packing between said crossover and said barrel closing the bottom of said annulus; and a casing surrounding said production tubing and being concentric therewith;

said discharge valve providing communication between said chamber and said annulus enabling said annulus to receive the mixture of well fluid and diluent and conduct the mixture to the surface out of contact with said plunger and said sucker rods.

3. A pumping installation as defined in claim 2 comprising in addition cooperating locking means on the outside of said barrel and the inside of said crossover.

4. In a subsurface pumping installation which includes:

a power tubing which conducts diluent from the surface;

a string of solid sucker rods extending from the surface down said power tubing within the diluent;

a pump having upper and lower barrels, upper and lower plungers in the respective barrels, a pull tube connecting said plungers, a crossover at the bottom of said lower barrel, and standing and discharge valves in said crossover, said upper barrel being joined to said power tubing, said upper plunger being joined to said sucker rod string;

means forming a blending chamber inside said pump beneath said lower plunger; and means forming a passage extending at least within said upper plunger and pull tube communicating with said power tubing and with one of said barrels for delivering diluent thereto and thence around said lower plunger to said chamber;

said plungers on their upstroke drawing well fluid through said standing valve into said chamber where it blends with diluent;

said plungers on their downstroke forcing a mixture of well fluid and diluent from said chamber through said discharge valve;

the improvement comprising:

means forming a fluid-conducting annulus which surrounds said power tubing and is concentric therewith; and means closing the bottom of said annulus;

said discharge valve providing communication between said chamber and said annulus enabling said annulus to receive the mixture of well fluid and diluent and conduct the mixture to the surface out of contact with said plungers and said sucker rods.

5. A pumping installation as defined in claim 4 in which said chamber is located above said discharge valve, said crossover having vertical passages for conducting well fluid around said discharge valve to said chamber and ports affording communication between said chamber and said annulus via said discharge valve.

6. A pumping installation as defined in claim 4 comprising in addition a check valve in said passage.

7. A pumping installation as defined in claim 4 comprising in addition inertia bars inserted between said sucker rod string and said upper plunger to add weight and maintain the sucker rods under tension.

* * * * *